US006096957A

United States Patent [19]

Andersen

[11] Patent Number: 6,096,957

[45] Date of Patent: Aug. 1, 2000

[54] FOOT OPERATED TAMBOURINE PLAYING DEVICE

[76] Inventor: Matt Andersen, P.O. Box 3157, Conroe, Tex. 77305

[21] Appl. No.: 09/288,124

[22] Filed: Apr. 8, 1999

[51] Int. Cl.[7] ..... G10D 13/02

[52] U.S. Cl. ..... 84/422.1; 84/422.2; 84/418

[58] Field of Search ..... 84/422.1, 422.2, 84/418, 419

[56] References Cited

U.S. PATENT DOCUMENTS 4,873,910 10/1989 Kurosaki ..... 84/422.1

*Primary Examiner*—Bentsu Ro
*Assistant Examiner*—Shih-yung Hsieh

[57] ABSTRACT

A foot operated tambourine playing device for playing the tambourine with a foot. The foot operated tambourine playing device includes a base panel and a foot pedal pivotally coupled to the base panel. The base panel is adapted for having a tambourine coupled to its lower surface.

9 Claims, 2 Drawing Sheets

FOOT OPERATED TAMBOURINE PLAYING DEVICE

BACKGROUND OF THE INVENTION

1. Field of the Invention

The present invention relates to foot operated musical devices and more particularly pertains to a new foot operated tambourine playing device for playing the tambourine with a foot.

2. Description of the Prior Art

The use of foot operated musical devices is known in the prior art. More specifically, foot operated musical devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,994,197; U.S. Pat. No. 3,481,239; U.S. Pat. No. 2,785,596; U.S. Pat. No. 2,475,542; U.S. Pat. No. 2,581,515; and U.S. Pat. No. Des. 390,253.

While these devices fulfill their respective, particular objectives and requirements, the aforementioned patents do not disclose a new foot operated tambourine playing device. The inventive device includes a base panel and a foot pedal pivotally coupled to said base panel. The base panel is adapted for having a tambourine coupled to its lower surface.

In these respects, the foot operated tambourine playing device according to the present invention substantially departs from the conventional concepts and designs of the prior art, and in so doing provides an apparatus primarily developed for the purpose of playing the tambourine with a foot.

SUMMARY OF THE INVENTION

In view of the foregoing disadvantages inherent in the known types of foot operated musical devices now present in the prior art, the present invention provides a new foot operated tambourine playing device construction wherein the same can be utilized for playing the tambourine with a foot.

The general purpose of the present invention, which will be described subsequently in greater detail, is to provide a new foot operated tambourine playing device apparatus and method which has many of the advantages of the foot operated musical devices mentioned heretofore and many novel features that result in a new foot operated tambourine playing device which is not anticipated, rendered obvious, suggested, or even implied by any of the prior art foot operated musical devices, either alone or in any combination thereof.

To attain this, the present invention generally comprises a base panel and a foot pedal pivotally coupled to said base panel. The base panel is adapted for having a tambourine coupled to its lower surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot operated tambourine playing device apparatus and method which has many of the advantages of the foot operated musical devices mentioned heretofore and many novel features that result in a new foot operated tambourine playing device which is not anticipated, rendered obvious, suggested, or even implied by any of the prior art foot operated musical devices, either alone or in any combination thereof.

It is another object of the present invention to provide a new foot operated tambourine playing device which may be easily and efficiently manufactured and marketed.

It is a further object of the present invention to provide a new foot operated tambourine playing device which is of a durable and reliable construction.

An even further object of the present invention is to provide a new foot operated tambourine playing device which is susceptible of a low cost of manufacture with regard to both materials and labor, and which accordingly is then susceptible of low prices of sale to the consuming public, thereby making such foot operated tambourine playing device economically available to the buying public.

Still yet another object of the present invention is to provide a new foot operated tambourine playing device which provides in the apparatuses and methods of the prior art some of the advantages thereof, while simultaneously overcoming some of the disadvantages normally associated therewith.

Still another object of the present invention is to provide a new foot operated tambourine playing device for playing the tambourine with a foot.

Yet another object of the present invention is to provide a new foot operated tambourine playing device which includes a base panel and a foot pedal pivotally coupled to said base panel. The base panel is adapted for having a tambourine coupled to its lower surface.

Still yet another object of the present invention is to provide a new foot operated tambourine playing device that permits a user to play more than one instrument at a time, such as, for example, a guitar and the tambourine. Thus a solo act has a fuller sound.

Even still another object of the present invention is to provide a new foot operated tambourine playing device that improves coordination.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof! Such description makes reference to the annexed drawings wherein.

DESCRIPTION OF THE PREFERRED EMBODIMENT

Figure 1:
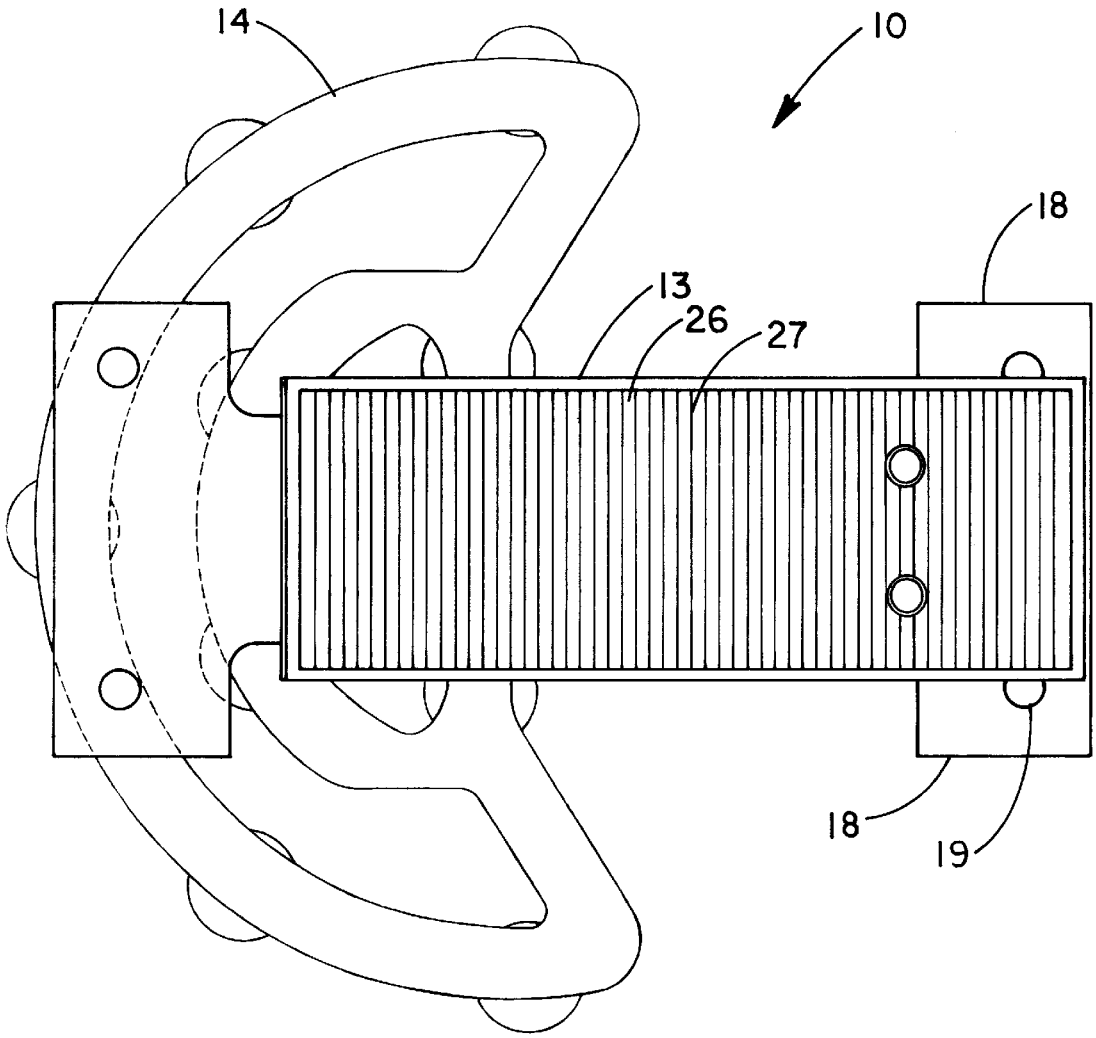
FIG. 1 is a schematic top view of a new foot operated tambourine playing device according to the present invention.
Figure 2:
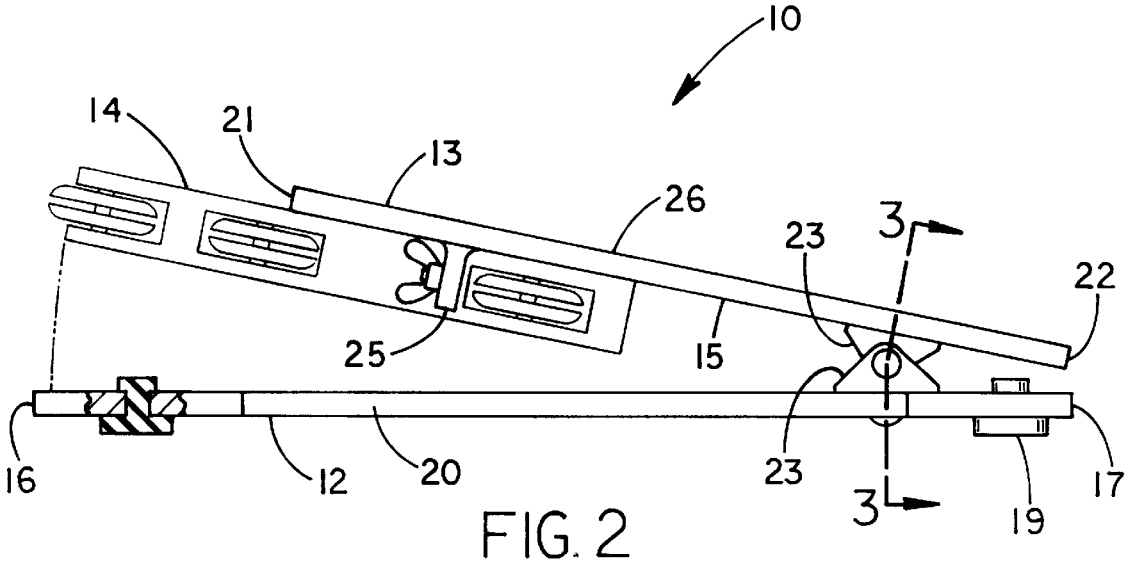
FIG. 2 is a schematic side view of the present invention with a partial breakaway view.
Figure 3:
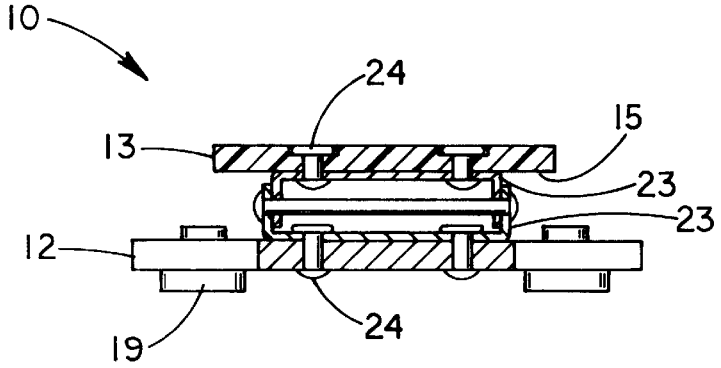
FIG. 3 is a schematic cross sectional view of the present invention taken from line 3—3 of FIG. 2.

With reference now to the drawings, and in particular to FIGS. 1 through 3 thereof, a new foot operated tambourine playing device embodying the principles and concepts of the present invention and generally designated by the reference numeral 10 will be described.

As best illustrated in FIGS. 1 through 3, the foot operated tambourine playing device 10 generally comprises a base panel 12 and a foot pedal 13 pivotally coupled to the base panel. The base panel is adapted for having a tambourine 14 coupled to its lower surface 15.

Preferably, the base panel has opposite front and back ends 16,17 and a longitudinal axis extending between the ends. Each of the ends of the base panel has a pair of flanges 18 outwardly extending therefrom generally perpendicular to the longitudinal axis of the base panel. The flanges provide greater stability and help prevent the device from tipping over.

Also preferably, each of the flanges of the base panel has a resiliently deformable rubber pad 19 extending downwardly therefrom. The pads are adapted for frictionally engaging a ground surface to prevent the device from sliding along the ground surface. Ideally, the pads are positioned outside imaginary lines extending along lateral sides 20 of the central portion of the base panel for maximum stability.

Preferably, the foot pedal has forward and rearward ends 21,22. The foot pedal is pivotally coupled to the base panel at a position spaced from the rearward end of the foot pedal. This permits the ball and heel of the foot to selectively pivot the foot pedal to shake the tambourine or strike the tambourine against the base panel. The heel lifts the forward end of the pedal, which is biased towards the ground surface by gravity. The preferred means of pivotally coupling the foot pedal to the base panel is a pair of opposed generally U-shaped coupling portions 23 fastened to the base panel and foot pedal by rivets 24.

The preferred length of the base panel between its ends is about 12 inches. The preferred length of the foot pedal is about 10 inches. This length is required so that the foot pedal is long enough to accommodate even large sized feet.

Preferably, the foot pedal has a mounting flange 25 downwardly extending from the lower surface thereof. The tambourine is coupled to the mounting flange.

Also preferably, an upper surface 26 of the foot pedal has a rubber corrugated surface 27 for frictionally engaging a foot.

Ideally, the front end of the base panel extends beyond the outer end of the tambourine so that the outer end of the tambourine strikes the front end of the base panel. This helps the tambourine produce more sound.

In use, a foot is placed on the upper surface of the foot pedal. The foot is rocked back and forth to shake the tambourine or strike it against the base panel to produce an audible sound.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot operated device for playing a tambourine, comprising:

a base panel;

a foot pedal pivotally coupled to said base panel, said foot pedal having a tambourine coupled to a lower surface thereof; and wherein said base panel has opposite front and back ends and a longitudinal axis extending between said ends, each of said ends of said base panel having a pair of flanges outwardly extending therefrom generally perpendicular to said longitudinal axis of said base panel.

2. The foot operated device of claim 1, wherein each of said flanges of said base panel has a resiliently deformable pad extending downwardly therefrom, said pads being adapted for frictionally engaging a ground surface.

3. The foot operated device of claim 1, wherein said foot pedal has forward and rearward ends, said foot pedal being pivotally coupled to said base panel at a position spaced from said rearward end of said foot pedal.

4. The foot operated device of claim 1, wherein said foot pedal has a mounting flange downwardly extending from said lower surface thereof, said tambourine being coupled to said mounting flange.

5. The foot operated device of claim 1, wherein an upper surface of said foot pedal has a corrugated surface for frictionally engaging a foot.

6. A foot operated musical instrument, comprising:

a base panel;

a foot pedal pivotally coupled to said base panel;

a tambourine coupled to a lower surface of said foot pedal;

said base panel having opposite front and back ends and a longitudinal axis extending between said ends, each of said ends of said base panel having a pair of flanges outwardly extending therefrom generally perpendicular to said longitudinal axis of said base panel;

each of said flanges of said base panel having a resiliently deformable pad extending downwardly therefrom;

said foot pedal having forward and rearward ends, said foot pedal being pivotally coupled to said base panel at a position spaced from said rearward end of said foot pedal;

said foot pedal having a mounting flange downwardly extending from said lower surface thereof, said tambourine being coupled to said mounting flange; and an upper surface of said foot pedal having a corrugated surface for frictionally engaging a foot.

7. A foot operated device for playing a tambourine, comprising:

a base panel;

a foot pedal pivotally coupled to said base panel, said foot pedal having a tambourine coupled to a lower surface thereof; and wherein said foot pedal has a mounting flange downwardly extending from said lower surface thereof, said tambourine being coupled to said mounting flange.

8. The foot operated device of claim 7, wherein said foot pedal has forward and rearward ends, said foot pedal being pivotally coupled to said base panel at a position spaced from said rearward end of said foot pedal.

9. The foot operated device of claim 7, wherein an upper surface of said foot pedal has a corrugated surface for frictionally engaging a foot.

* * * * *